US009153093B2

(12) United States Patent
Hartley

(10) Patent No.: US 9,153,093 B2
(45) Date of Patent: Oct. 6, 2015

(54) USING REAL PLAYING CARDS FOR ONLINE GAMING

(76) Inventor: Peter Hartley, Chamblee, GA (US)

( * ) Notice: Subject to any disclaimer, the term of this patent is extended or adjusted under 35 U.S.C. 154(b) by 179 days.

(21) Appl. No.: 12/898,634

(22) Filed: Oct. 5, 2010

(65) Prior Publication Data

US 2011/0079959 A1 Apr. 7, 2011

Related U.S. Application Data

(60) Provisional application No. 61/248,635, filed on Oct. 5, 2009.

(51) Int. Cl.
*A63F 9/00* (2006.01)
*G07F 17/32* (2006.01)

(52) U.S. Cl.
CPC ..... *G07F 17/3223* (2013.01); *G07F 17/32* (2013.01); *G07F 17/3293* (2013.01)

(58) Field of Classification Search
USPC ..... 463/22
See application file for complete search history.

(56) References Cited

U.S. PATENT DOCUMENTS

| | | | | |
|---|---|---|---|---|
| 5,707,287 | A * | 1/1998 | McCrea, Jr. | 463/27 |
| 5,735,525 | A * | 4/1998 | McCrea, Jr. | 273/309 |
| 6,299,534 | B1 * | 10/2001 | Breeding et al. | 463/25 |
| 6,341,778 | B1 * | 1/2002 | Lee | 273/292 |
| 6,386,973 | B1 * | 5/2002 | Yoseloff | 463/13 |
| 6,582,301 | B2 * | 6/2003 | Hill | 463/11 |
| 6,755,741 | B1 * | 6/2004 | Rafaeli | 463/25 |
| 7,699,694 | B2 * | 4/2010 | Hill | 463/11 |
| 2002/0068635 | A1 * | 6/2002 | Hill | 463/47 |
| 2003/0195025 | A1 * | 10/2003 | Hill | 463/11 |
| 2005/0054408 | A1 * | 3/2005 | Steil et al. | 463/11 |
| 2006/0030404 | A1 * | 2/2006 | Pohlman | 463/29 |
| 2006/0040741 | A1 * | 2/2006 | Griswold et al. | 463/40 |
| 2006/0046853 | A1 * | 3/2006 | Black | 463/42 |
| 2006/0100013 | A1 * | 5/2006 | Enzminger | 463/30 |
| 2006/0205508 | A1 * | 9/2006 | Green | 463/40 |
| 2006/0217199 | A1 * | 9/2006 | Adcox et al. | 463/40 |
| 2007/0015583 | A1 * | 1/2007 | Tran | 463/40 |
| 2007/0060260 | A1 * | 3/2007 | Fleckenstein | 463/16 |
| 2007/0111772 | A1 * | 5/2007 | Shuster et al. | 463/11 |
| 2007/0178955 | A1 * | 8/2007 | Mills | 463/13 |
| 2008/0026807 | A1 * | 1/2008 | Moshal et al. | 463/16 |
| 2008/0220836 | A1 * | 9/2008 | Nagano | 463/12 |
| 2008/0234024 | A1 * | 9/2008 | Connors et al. | 463/11 |
| 2009/0088237 | A1 * | 4/2009 | Hsu | 463/12 |
| 2009/0093300 | A1 * | 4/2009 | Lutnick et al. | 463/26 |
| 2009/0118006 | A1 * | 5/2009 | Kelly et al. | 463/31 |
| 2009/0181741 | A1 * | 7/2009 | Hsu | 463/11 |
| 2011/0079959 | A1 * | 4/2011 | Hartley | 273/292 |

* cited by examiner

*Primary Examiner* — Seng H Lim
(74) *Attorney, Agent, or Firm* — Gardner Groff Greenwald & Villanueva, P.C.

(57) ABSTRACT

On or more apparatuses, systems, and methods are disclosed for playing an online card game using real cards. Real playing cards are transferred from a deck of playing cards to a card holding position in a card holder, such as for a sufficient number of players for a game. From an appropriate card viewing position, an actual image of the card (either front or back) is captured, such as by a video camera. The captured image of the card is used to display to an online player, who is playing a virtual card game, such as poker, where the online player may be locally or remotely connected. The image of the card is used in lieu of a virtual image in the virtual representation of an online card game.

20 Claims, 9 Drawing Sheets

USING REAL PLAYING CARDS FOR ONLINE GAMING

REFERENCE TO RELATED APPLICATIONS

This application claims the benefit of U.S. Provisional Application 61/248,635, filed Oct. 5, 2009, which is incorporated by reference herein in its entirety.

BACKGROUND

Online gaming has become extremely popular and draws increasing numbers of players every year. Common online gaming includes poker and other games conventionally played with playing cards such as standard 52-card decks. In the electronic (e.g., video) and online gaming versions, however, the "cards" dealt to respective players are virtual cards generated by a computing device. The computing device typically comprises a remote server, which may have an operable connection to the Internet in the case of online gaming, and/or to local video display terminal in the case of local video gaming. Players can access the virtual cards through the local terminal, and/or using a remote communications device such as desktop computers, laptop computers, webphones, PDAs, etc. To ensure fairness and credibility, the virtual cards that are virtually dealt must be randomly generated so that neither any one player nor the house gains an unfair advantage.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

It is possible that the operators (i.e., the "house") of some gaming systems can manipulate the random generation of virtual cards in order to "fix" the games to the advantage of the house or a selected one of the players. For example, well known online poker sites were suspected of having "super users" playing on their sites, where the "super users" could see the virtual cards of respective players at a virtual table, using this information to deceive players out of large sums of money. Technology may exist on online poker sites and video poker systems for individuals involved in the management and/or software development and implementation to use a Super User account that allows them to see other player's virtual cards.

Currently, video poker and online poker gaming typically use a random number generator (RNG) to electronically shuffle and deal the virtual cards. RNGs can provide cards that are dealt in as random a manner as may be found with a real pack of cards. While RNGs can provide for randomly dealt cards, they are subject to being programmed in an unfair way, much like slot apparatuses, such as to pay out less than they take in. For example, the RNGs can be programmed so that certain user names, either highly privileged staff members or computer generated players can receive better hands than those dealt to genuine players. Programming may be used to give new players and/or long term players, winning runs, such as to keep players playing.

Some online gaming systems utilize internal and external security checks, designed to provide users a certain level of trustworthiness. These security checks can be performed by third-party entities to attempt to uncover and prevent potential cheating. Other online gaming systems utilize real cards, which comprise bar codes that are scanned when dealt to players, such as to provide for post game checks (e.g., to review the dealing and play of cards using the scans). However, these techniques and systems still utilize virtual cards displayed to the users, which still have a potential to be "gamed" by programming or other means.

Techniques and systems are disclosed for improvements in online gaming, for example, to provide increased credibility and to mitigate a likelihood of "fixing" a card game by a gaming system operator. Real cards can be shuffled, dealt and displayed to online players, for example, where the players can view respective aspects of the handling of the card. Further, because the real cards are dealt to and viewed by respective players, such as by cameras or other monitoring devices, programmatic manipulation in favor of one or more players, and/or the "house" can be mitigated. In this way, for example, online players may be provided with a greater sense of credibility of fairness of the online game, where it can be less likely for "gaming" or "fixing" of a game.

In one embodiment, an apparatus for playing an online card game using real cards can comprise a card holding component that holds a playing card so that it can be viewed from a first view position during a card game, and where the card holding component comprises a sufficient number of card holding positions for playing a desired card game with a desired number of players. In this embodiment, a card image capture component can capture an image of the playing card from the first view position, such that the image can be displayed to a player of the card game, for example, as an actual image of the card in a virtualized display of the card game. Further, in this embodiment, a card delivery component can transfer the playing card from a deck of playing cards to the card holding position.

In one embodiment, a system for providing an online card game using real cards comprises a real card playing component that can automatically deal playing cards from a deck of real playing cards to a card holding component for respective cards dealt during the card game, capture an image of the respective playing cards in the card holding component during the card game, and automatically capture and arrange discarded playing cards for arrangement into the deck of real playing cards. In this embodiment, a card display component can display the image of respective playing cards as one or more played cards to one or more players of the card game during the card game. Further, in this embodiment, a control component can control an operation of the real card playing component in response to an action of a player of the card game, and/or appropriate game flow of the card game.

In another embodiment, a method for providing an online card game using real cards can comprise automatically preparing a deck of playing cards for use in the card game, such as mixing, evaluating and shuffling. In this embodiment, a playing card can be automatically dealt to a card viewing position from the deck of playing cards, and an image of the dealt playing card can be captured from the card viewing position. Further, in this embodiment, the captured image of the dealt playing card can be displayed to an online player of the card game in a virtual display of the game, and the playing card can be manipulated in response to one or more actions from the online player.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DETAILED DESCRIPTION

Figure 1:
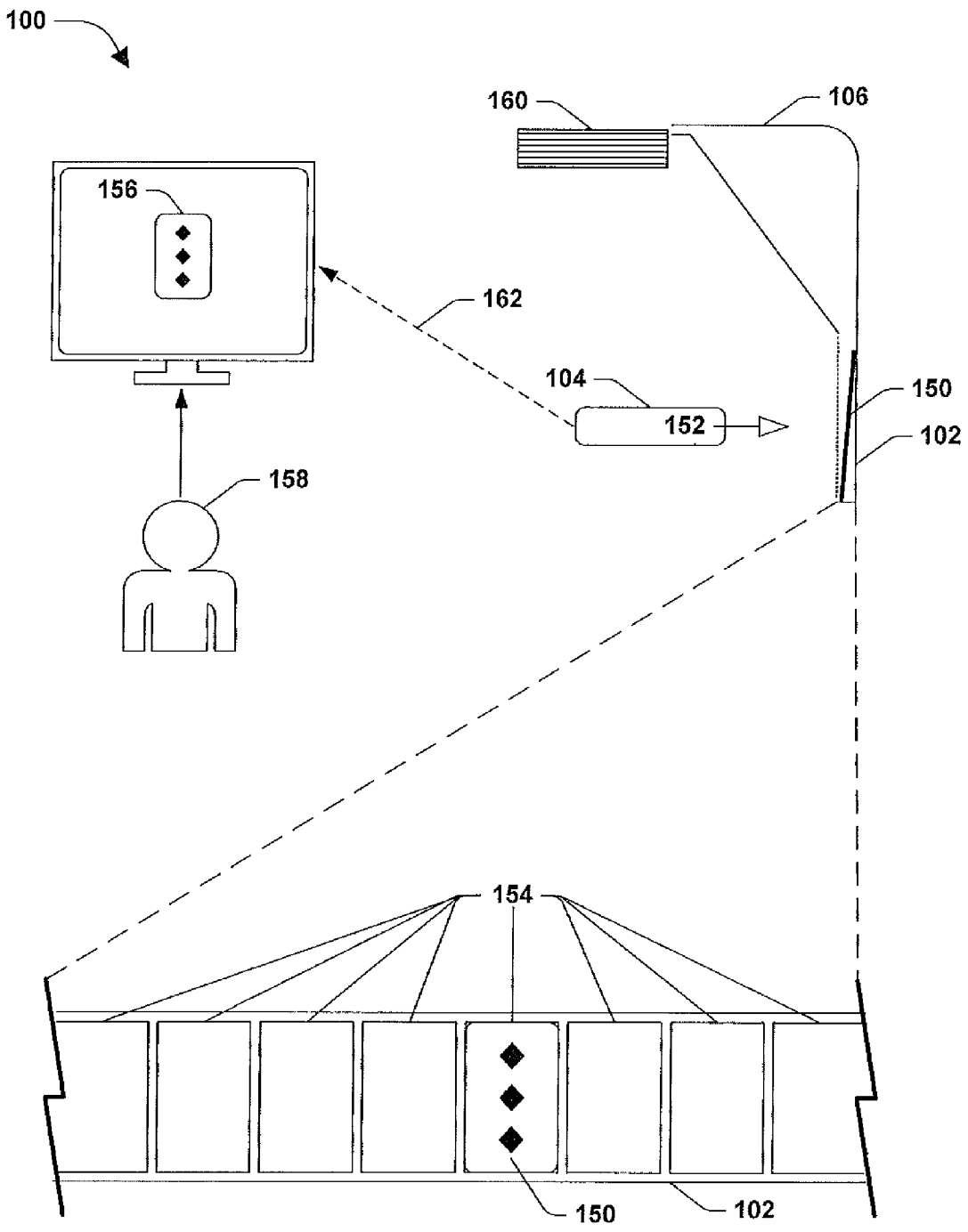
FIG. 1 is a component diagram illustrating an example apparatus for playing an online card game using real cards.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Techniques and systems, described herein, generally relate to real-card playing apparatuses for online gaming and to online gaming systems and methods that can utilize the real-card playing apparatuses. These apparatuses, systems, and methods are designed for playing card games, such as poker, for example, using conventional fifty-two card-deck or customized playing cards. In some embodiments, a common card game played by a real-card apparatus can be Texas Hold 'em poker. In other embodiments, the apparatuses, systems, and methods can be adapted for playing draw poker, stud poker, blackjack, or other conventional or newly developed card games.

In contrast to conventional online gaming, the card-playing apparatuses, gaming systems and methods described herein utilize one or more actual physical decks of playing cards. As an illustrative example, because real cards are used, instead of computer generated virtual cards, the method and systems utilizing the card-playing apparatuses are less likely to be manipulated and therefore more credible to players, which is a significant advantage over current or previous gaming systems. Further, the systems and techniques, described herein, that may utilize the real-card playing apparatus are configured to be highly automated by including automated dealing, shuffling, and evaluation for re-use mechanisms, for example. In this way, in this example, merely one person may oversee an operation of multiple apparatuses at a same time, which can be a significant advantage over current or previous gaming systems.

FIG. 1 is a component diagram illustrating an example apparatus 100 for playing an online card game using real cards. The example apparatus 100 comprises a card holding component 102 that holds a playing card 150 such that the playing card 150 (e.g., a face of the card) is able to be viewed from a first view position 152 during a card game. The example card holding component 102 comprises a sufficient number of card holding positions 154 such that a desired card game can be played with a desired number of players. A card-image capture component 104 captures an image 156 of the playing card 150 from the first view position 152, so that the image 156 can be displayed (e.g., using a network connection 162) to a player 158 of the card game. A card delivery component 106 transfers the playing card 150 from a deck of playing cards 160 to the card holding position 154.

As an illustrative example, the card delivery component 106 can transfer (e.g., deal) cards (e.g., 150) from the deck of playing cards 160 to an appropriate card holding position for the card game, for respective of the online players. For example, where the game comprises "Texas hold-em," respective players receive two "down" cards that are viewed merely by the player dealt the down cards; five cards are displayed "up" for all players to view; and a pile of discarded or "burn" cards are placed face down for no player to view. In this example, the sufficient number of card holding positions 154 can comprise enough positions to play a game with a desired number of players.

Commonly, in Texas hold-em, up to ten players may play a same game at a same time, for example. In this example, the card holding positions can comprise two for respective potential players (e.g., twenty), five for the up cards, and one for the discard pile; therefore, there may be twenty six card holding positions (e.g., or twenty eight for three burn piles) to play the card game. Alternately, where a different card game (e.g., seven card stud, blackjack, three-card let it ride, Caribbean poker, etc.) is played, an appropriate number of card holding positions can be employed. In one embodiment, the example apparatus may comprise a sufficient number of card holding positions to play respective games available, and merely a number of positions needed to play the card game can be utilized for the card game.

Further, in one embodiment, the card holding component 102 can comprise a viewing window that allows the card to be viewed from the first view position 152. For example, the window may merely comprise an opening that provides a view of the card. Alternately, the window may comprise an optically clear covering (e.g., glass, a clear polymer, etc.). In this way, for example, the card image capture component 104 can capture an image of the card through the window when in the card holding position 154. In one embodiment, the captured image of the card can be transferred over a network connection (e.g., 162) to be displayed on a monitor (e.g., computer monitor, smartphone screen, television, mobile device screen, video display unit, video poker machine screen), such that the captured image 156 can be viewed by a player 158 in the card game. For example, instead of displaying virtual cards (e.g., computer generated graphics representing a card in a game) an online card game can display the captured image of the playing card.

Further, in one embodiment, a face of the card can be displayed, where appropriate, and/or a back of the card can be displayed, where appropriate. For example, a first image capture component (e.g., 104) may be positioned to capture a face of the playing card, such as to display to a user as their "down" cards, and a second image capture component may be positioned to display a back of the card, such as to display other player's down cards, the discard pile, or other down cards (e.g., a dealer's down cards in blackjack). Alternately, the card delivery component 106 may be configured to turn a playing card (e.g., with an active turning mechanism, and/or one or more stationary turning mechanisms) such that a desired side of the card (e.g., face or back) is facing the image capture component 104.

Figure 2:
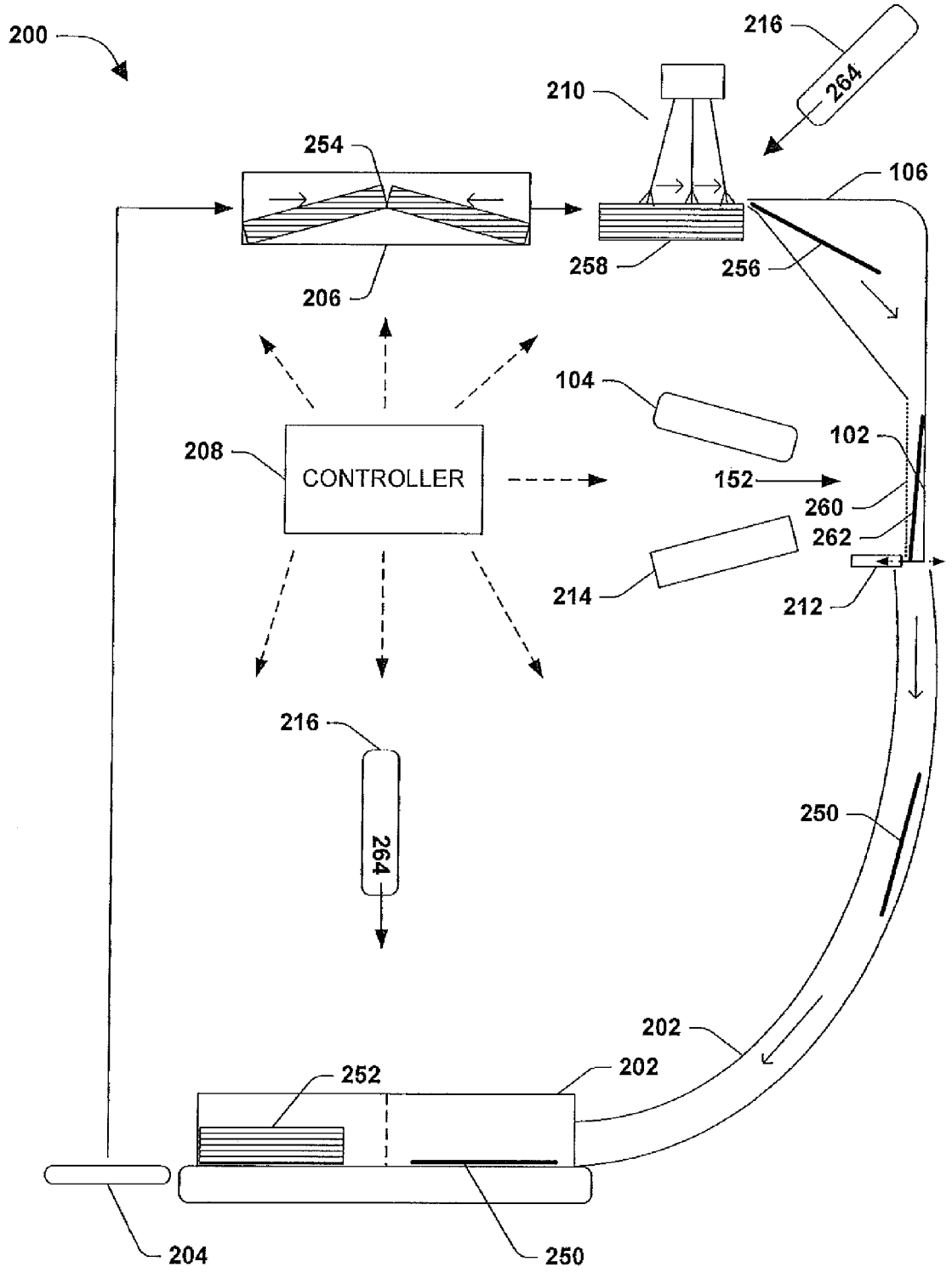
FIG. 2 is a component diagrams illustrating example an embodiment of one or more apparatuses described herein.
Figure 3:
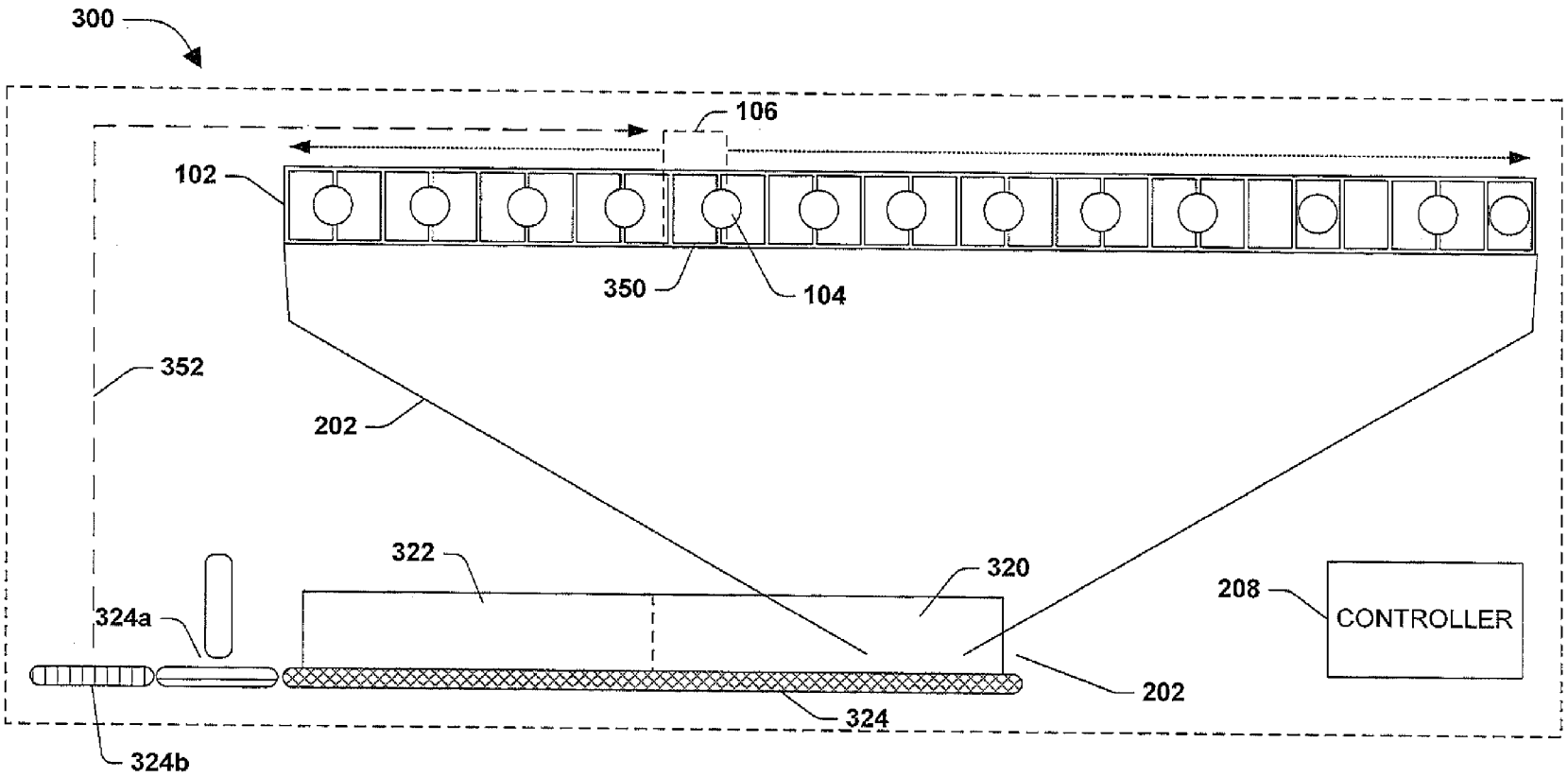
FIG. 3 is a component diagrams illustrating example an embodiment of one or more apparatuses described herein.

FIGS. 2 and 3 are component diagrams illustrating example embodiments 200, 300 of one or more apparatuses described herein. In the example embodiment 200 of FIG. 2, the card holding component 102 can comprise a discard component 212 that is associated with each of the card holding positions. In this embodiment, the discard component 212 can release the playing card 262 from the card holding position 260 to a card retrieval component 202 for reorganization into a deck of playing cards 252. The card retrieval component 202 can collect the card 250 when discarded from the card holding position 260 for reorganization into the deck 252.

In one embodiment, the discard component 212 can comprise merely a pin/piston on which the card 262 resides in the card holding position 260. In this embodiment, the pin/piston can be connected to an actuator that may draw the pin in to cause the card to drop to the card retrieval component 202; and out, to receive and hold a next card. In another embodiment, the discard component 212 can comprise an outlet door and actuator. In this embodiment, the outlet door can be open by the actuator to permit the card to exit to the card retrieval component 202. The doors can be configured to move from a closed position covering an outlet of the card holding position, to an open position permitting the respective cards to exit. As an illustrative example, the doors can be pivotally coupled to the card holding component 102, and the actuator may be a linear-drive actuator.

In the example embodiment 300 of FIG. 3, the card retrieval component 202 can be configured to receive cards from respective card holding positions 350 of the card holding component 102. In one embodiment, the retrieved cards may travel to a collection area 320 of the card retrieval component 202, for example, which can collect the cards as they are discarded, mix the cards, and move them to a deck arrangement area 324, such as using a conveyor component 324. In this example, the deck arrangement area 322 of the card retrieval component 202 can be configured to arrange the collected and mixed cards into decks. In one embodiment, the mixing and arranging may be performed using mechanical components that actively mix and arrange the cards, and/or static components that passively mix and arrange the cards while moving along the conveyor 324.

Returning to FIG. 2, a card evaluation component 204 can evaluate a deck of playing cards 252 to determine whether the deck is suitable for use in a game. For example, after the card retrieval component 202 collects discarded cards 250, and organizes them into a deck 252, the card evaluation component 204 may determine whether there are a proper number of cards in the deck 252 to play the desired game. Typical poker decks comprise fifty-two cards, where a beginning weight of the fifty-two cards can be determined (or known), for example. In one embodiment, the card evaluation component 204 may be configured to weigh the deck of cards to determine whether the weight matches a desired threshold value (e.g., within a pre-determined range for a deck) for a full deck of cards (e.g., all fifty-two cards are present for poker). In one embodiment, if the cards do not meet the desired threshold for the evaluation, the deck may be discarded or removed from any additional play.

In the example embodiment 300 of FIG. 3, the card evaluation component 324 can comprise one or more components 324*a*, 324*b*. In this example, the card evaluation component 324 can comprise a card reader 324*a* that reads respective cards of the deck, for example, to determine whether each card is present, and/or to evaluate a condition (e.g., damaged, alignment, wrong deck, etc.) of the card. For example, the card reader 324*a* may comprise a camera that captures an image that can be compared with a threshold image. Further, a code on/in the card may be read by the reader (e.g., bar code, RFID). Additionally, the card evaluation component 324 can further comprise a weight evaluation component 324*b*, such as described above.

In the example embodiment 200 of FIG. 2, a card shuffling component 206 can shuffle the deck of playing cards 254 prior to using the deck in the card game. The card delivery component 106 can comprise a card dealing component 210 that removes the playing card 256 from a top of the deck 258 to be delivered to the card holding position 260. For example, the card dealing component 210 comprises a means, such as a suction cup, gripper, wheel, etc. that enables merely the top card to removed from the deck and transferred to respective card holding positions for a desired game. In alternative embodiments, two or more card-dealing component 210 may be coupled with one or more card delivery components 106, one or more card shuffling components 206, and/or one or more deck-evaluation components 204, or vice versa, depending on the game (i.e., how long it typically takes to go through each deck.)

A code scanning component 214 can read a code on the playing card 262 from the first view position 152 to determine a value of the playing card 262. Alternately, code scanning component 214 can read a code on the playing card 262 from the first view position 152 to determine security information for the playing card. For example, respective cards in the deck 258 can comprise a one dimensional bar code, a two-dimensional matrix code, RFID, or some other code attached, imprinted, or otherwise connected to the playing card. In this example, the code can be read by the code scanning component 214, where the code, at least in part, identifies a face value of the card (e.g., king of hearts). Further, in this example, the code can detect whether the card is a potential security issue. That is, for example, the card may be counterfeit, misplaced, misaligned, or damaged, and the code may be used to detect one or more of these concerns.

A game image capture component 216 can capture one or more images of the card playing apparatus during the card game from one or more second viewing positions 264. In this embodiment, the one or more images from the one or more second viewing positions 264 can comprise the playing cards handled by respective components of the apparatus. For example, the game image capture component 216 can collect one or more image views (e.g., from one or more cameras, such as a video camera) of the operation of the real-card playing apparatus, where card handling can be captured. In this example, the captured images of the operation can be provided to a player, who may view how the cards are being handled, such as to ensure that no issues of cheating or manipulating the cards is undertaken.

A control component 208 can provide control commands to operate one or more of the various components of the apparatus, such as the card image capture component 104; the card delivery component 106; the card holding component 102; the card evaluation component 204; the code scanning component 214; the discard component 212; the card retrieval component 202; the game image capture component; the card shuffling component; and the card dealing component 210. In one embodiment, the control component 208 can provide commands to the one or more components of the example apparatus in response to actions from one or more players in the game (e.g., a fold action by a player can cause the controller to send a command to the discard component 212 for the player's holding position to discard the card to the card retrieval component 202). In another embodiment, the control component 208 can provide commands to the one or more components of the example apparatus in response to game flow operations for the game (e.g., at a beginning of the game the controller can send commands to the card dealing component 210 to begin dealing cards).

In the example embodiment 300 of FIG. 3, the example apparatus can comprise a means for transferring 352 the deck of playing cards that has been evaluated to the card shuffler (not shown), and/or the card delivery component 106. Further, in one embodiment, the card delivery component 106 is configured to move to respective card holding positions 350 of the card holding component 102, in order to deliver playing cards from the deck. For example, a linear actuator, cable and pulley, electromagnetic component, or some other movement mechanism, may be operably coupled with the card delivery component 106 so that it can be moved along the card holding component 102 to appropriate card holding positions 350 when the cards are dealt from the deck.

In one embodiment, a plurality of image capture components 104 can be utilized in the example apparatus 300. In this embodiment, depending on a desired card game, the respective plurality of image capture components 104 can be configured to capture an image of one or more cards at a same time. For example, an apparatus may be configured with one camera for respective player's "down" cards (e.g., two in Texas hold-em), one or more cameras for the "up" cards (e.g., one for the "flop," and one or two for the "river" in Texas hold-em), and one for the discard or unseen cards (e.g., the burn pile). In another embodiment, the image capture components 104 may be configured to be moved to one or more card holding positions 350. For example, the image capture component 104 may be coupled to the card delivery component 106, such that the image capture component 104 can move to respective card holding positions 350, capture an image of the card delivered, and move to a next position.

In one embodiment, the card-playing apparatus, a deck of cards may be held in place for the card dealing component using a tray, box, or other container for holding in place the deck of cards. The card delivery component may comprise a counter-weight assembly or spring element (e.g., a compression or leaf spring) or another conventional structure that is adapted to bias the cards in the deck toward the card dealing component. In one embodiment, the card dealing component can comprise a picker arm with a card-gripping surface defined by, for example, a suction cup as shown in FIG. 2.

In one embodiment, a drive mechanism can be provided, for example, by a linkage, cam assembly, or other structure for pivoting for translating an arm of the dealing component through a back-and-forth motion such that the gripper (e.g., suction cup) moves from a start position to engage and remove the top card from the deck, disengages from the top card, returns to the start position, and repeats this process to deal the cards. In alternative embodiments, the card dealing component can comprise a rotary wheel with a plurality of card-engaging surfaces (e.g., suction cups or other soft plastic card-gripping elements) or another conventional structure adapted to remove the top card from the deck. Further, an actuator for the card advancer may be provided by a conventional actuator such as a rotary or linear motor, a solenoid, a pneumatic or hydraulic cylinder, or another actuator that drives the picker arm directly or using the a control mechanism.

In one embodiment, the card holding component 102 can receive the card from the card-dealing component (e.g., 210). In this embodiment, the card can be transported from the card-dealing component 210 to the card holding component 102 by a transport structure (e.g., 106). In the example embodiment of FIG. 2, for example, the transport structure 106 comprises a card delivery chute that extends from the card-dealing component 210 to a card holding position 260 of the card holding component 102. In this example, the depicted chute can be configured such that the cards 256, which are in a generally horizontal orientation on top of the deck 258, are permitted to pivot and slide under the influence of gravity into a generally vertical orientation and to the card holding position 260 of the card-holding component 102. As an illustrative example, transport structure 106 (and other components) can be made of a metal, plastic, or other suitable material. In alternative embodiments, the transport structure can be comprise of a series of chutes, by a conveyor (e.g., a belt or chain conveyor), or it is eliminated and the cards are transported directly from the card-dealing mechanism 210 to card-holding component 102.

In one embodiment, the card holding component may comprise a card rack with a series of card slots. The card rack can be made of a metal, plastic, or other suitable material, can be elongate with the card slots arranged linearly along the length of the rack. In this embodiment, the card slots may be sized and shaped to respectively house a desired number of cards (e.g., one per slot). In this embodiment, the card slots can respectively comprise a window through which a face (or back) of a housed card can be viewed (e.g., from the first view position). The rack may be configured with a number and arrangement of card slots selected based on a card game to be played when using the real-card playing apparatus (e.g., 100 of FIG. 1). As an example, the rack may be configured for nine players to play Texas Hold'em poker. As such, the rack can comprise nine sets of slots with respective set comprising a pair of slots for the respective player's two down cards (e.g., hole cards), five slots for the five community cards (e.g., "up" cards) and one discard slot. As described above, the discard slot can be used to "burn" a card for example before the flop (i.e., the first three community cards), the turn (i.e., the fourth community card), and the river (i.e., the fifth community card).

In an alternative embodiment, the rack may comprise one set of card slots per player, with each set comprising five slots for five card draw or stud poker or seven slots for seven card stud poker, for example. In another embodiment, the rack can comprise one set of card slots per player, with respective sets comprising a larger number (e.g., eleven) of slots for blackjack poker. A number of sets of card slots, for example, can be selected to match a maximum number of players in the game.

In one embodiment, a card holding component (rack) comprising a given number of card holding positions (card slots) may be used to play a variety of different card games by programming the controller accordingly. That is, for example, the rack 102 shown in FIG. 3 comprises twenty-six slots 350 and the controller 208 may be programmed for ten players to play Texas Hold'em. However, the controller 208 can alternatively be programmed to use the rack 102 for four players to play five card stud or draw (e.g., with four extra/unused slots), three players to play seven card stud or draw (with three extra/unused slots), etc., for example. Therefore, in one embodiment, a use of the slots 350 may be defined by the controller 208, not the rack 102.

In one embodiment, the card holding component 102 can be stationary and the card delivery component 106 can traverse along the card holding component 102 to dispense cards into the card holding positions. That is, the card delivery component can move laterally along the card holding component to a selected card holding position, and the card dealing component (e.g., 210 of FIG. 2) can be actuated to remove a top card and deliver it through the card delivery component and into the selected holding position. To provide for this traversing movement, the card delivery component can include a linear delivery assembly, for example. In one embodiment, the delivery assembly can comprise a track actuator with a track, a block that slides along the track, and an actuator that drives the sliding block along the track, with the card delivery component mounted to the sliding block. In alternative embodiments, the linear delivery assembly can comprise gearing, drive belts/chains, or another conventional linear drive assembly that functions to selectively move the card delivery component linearly along the card holding component to position the delivery component adjacent the holding position. In other alternative embodiments, the card delivery component can be stationary and the card holding component may traverse to selectively position the card holding position inlets in alignment with the card delivery component.

Figure 4:
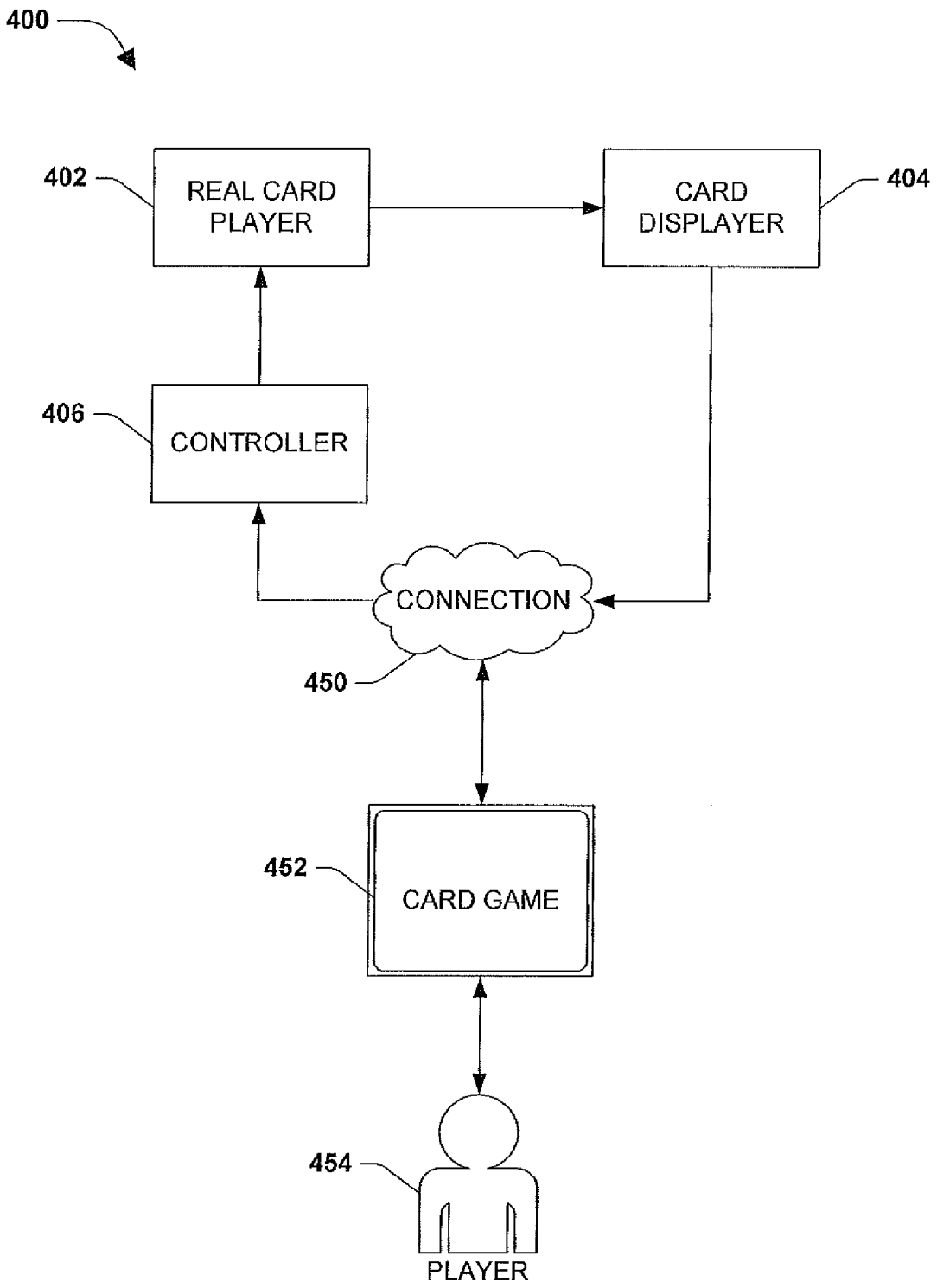
FIG. 4 is a component diagram of an example system for providing an online card game using real cards.

A gaming system may be devised that utilizes real cards in a display to online players. FIG. 4 is a component diagram of an example system 400 for providing an online card game using real cards. A real card playing component 402 automatically deals playing cards from a deck of real playing cards to a card holding component for respective cards dealt during the card game. Further, the real card playing component 402 captures an image of the respective playing cards in the card holding component during the card game. Additionally, the real card playing component 402 automatically captures and arranges discarded playing cards for arrangement into the deck of real playing cards.

In the example system 400, a card display component 404 is operably coupled with the real card playing component 402. The card display component 404 displays the image of respective playing cards 452 as one or more played cards to one or more players 454 of the card game during the card game. For example, the card display component can use the captured image of a card (e.g., a still image or live video feed) to represent the player's card when displayed in the card game on the players screen, instead of creating a virtualized version of the card (e.g., a computer generated graphical representation of the card). In this way, in this example, respective players of the card game can actually see their card as it is played during the game. Further, a potential of programming problems (e.g., fraud, cheating, mistakes) can be mitigated when the actual card is displayed to the player.

A control component 406 controls an operation of the real card playing component 402 in response to an action of a player of the card game, and/or appropriate game flow of the card game. For example, the player 454 can be connected to the online game over a network connection 450, such as using their personal computer, mobile device, smartphone, or other game playing device. In this example, when the player performs an action that warrants a response in the card game (e.g., folds) the controller 406 can respond to the online user's action by causing an appropriate response in the real-card playing component 402 (e.g., discard the player's cards).

It will be appreciated, that the term "online" can comprise a connection from a local device to a remote server, such as a connection over the internet, for example. Further, "online" can comprise a local connection from a local device to a local server, such as an onsite video poker machine connecting to an onsite server that comprises one or more components of the example systems described herein. Therefore, as an illustrative example, the systems described herein may be devised to employ an Internet-based connection, mobile network connection, intranet connection, or any other network or local communication between one or more of the system's components and an online player.

Figure 5:
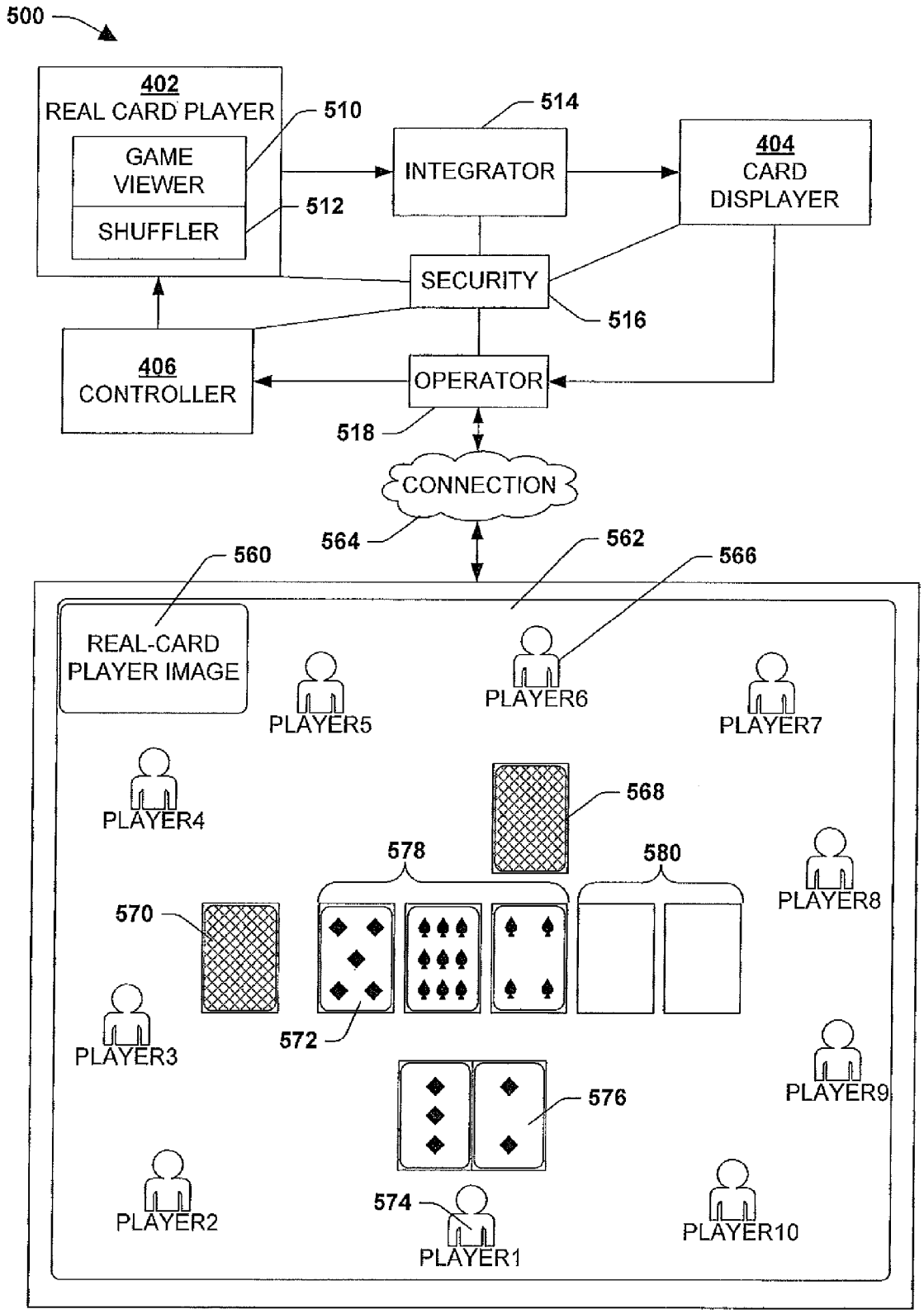
FIG. 5 is a component diagram illustrating an example embodiment of an implementation of one or more systems described herein.

FIG. 5 is a component diagram illustrating an example embodiment 500 of an implementation of one or more systems described herein. In this embodiment 500, the real card playing component 402 comprises a card shuffling component 512 that can automatically shuffle the deck of real playing cards prior to the cards being dealt for the card game. Further, real-card playing component 402 comprises a game viewing component 510. The game viewing component 510 can capture an image of the real card playing component 402, and/or components thereof, where the image comprises the playing cards that are handled by the real card playing component.

Further, the game viewing component 510 can display the image 560 of the real card playing component 402 to one or more players 566. For example, one or more image capture devices (e.g., cameras) may be positioned to capture an image (e.g., live video) of the how the cards are handled by the real-card playing component 402. Therefore, respective players may choose to watch how the cards are handled, such during collection, shuffling, dealing, etc. In this way, for example, the player may have a heightened sense of fairness to the game, by knowing that the cards are not being manipulated in an unfair manner.

In this embodiment 500, the card display component 404 can display a face of a player dealt card 576 merely to the player dealt the card 574. That is, for example, an actual image of the player's down cards (e.g., hole cards) can be shown only to that player. Further, the card display component 404 can display a face of a common playing card 572 to respective players of the card game 566. For example, card game playing programs may utilize frames 578, 580 in the virtual card game 562 that provide for displaying the captured image of the cards 572, 576. In this example, frames can be provided for the "flop" 578, and the "river" (e.g., or any other combination of cards played, such as player's down cards, common cards). Additionally, the card display component 404 can display a back of a down 570 (e.g., top of deck) or discard playing card 570 (e.g., burn pile) to respective players of the card game 566.

A card game operating component 518 can provide a user interface 562 to a player to play the online card game, for example, comprising the virtualized card game and actual images of the cards played during the game. Further, the card game operating component 518 can operate a flow of the online card game for one or more respective players 566. For example, the card game operating component 518 can perform virtualization tasks for the online players, such as placing bets, subtracting bets from accounts, arranging players, log in and out players, provide typical game flow operations in the user interface, etc. Additionally, the card game operating component 518 can activate actions in the real card playing component 402 to accommodate the flow of the online card game. For example, the card game operating component 518 can be operably coupled with the controller 406, and interpret actions from the online game, such as from interaction by a player with the user interface. In this example, the interpreted actions can be passed to the controller 406, which can provide appropriate commands to the one or more components of the real-card playing component 402 to respond to the action(s).

An integration component 514 can integrate the one or more images of the one or more playing cards, from the real-card player 402, into a virtual display of the card game 562. A security component 516 can mitigate unauthorized access to the system, mitigate unauthorized manipulation of the real card playing component, and mitigate unauthorized access to one or more images of the playing card or real-card playing component. For example, in one embodiment, the security component can be operably coupled with one or more component of the example system 500 to provide security services. In one embodiment, the security component may comprise programming, and/or hardware components. In one embodiment, the security component may utilize components of the example system, such as image capture components, code scanning components, and controller components to determine whether a security concern is present. In one embodiment, the security component can perform an operation to mitigate the security concern (e.g., deny access), alert a secondary security protocol (e.g., an administrator), or a combination of these.

In one embodiment, an optical character recognition (OCR) program may be utilized in connection with one or more of the image capture components of the real-card player component 402, for example, to recognize a face value and suit of the cards. In addition, the cards can be customized with codes, as described above, and programming may be used for reading the codes to recognize the face value and suit of the cards. In alternative embodiments, a card image capture component can comprise merely a camera or only a code reader, or by other conventional devices such as magnetic stripe scanners that read magnetic strips on customized cards, by RE receivers/transceivers that read RFID chips on customized cards, etc.

In one embodiment, the components of the exemplary system can comprise conventional computer components and programming for carrying operations of the system. Further, components of the exemplary system may be connected to, and/or comprises on a server computer, such as connect by a communications network 564, for example. In one embodiment, the exemplary system can be incorporated into a gaming system for playing any randomly-generated card game using any type of communications device with a video display of the cards. The or more exemplary systems may be used for playing poker and other card games online, with the server remotely located and connected to communications network 564, for example.

Figure 6:
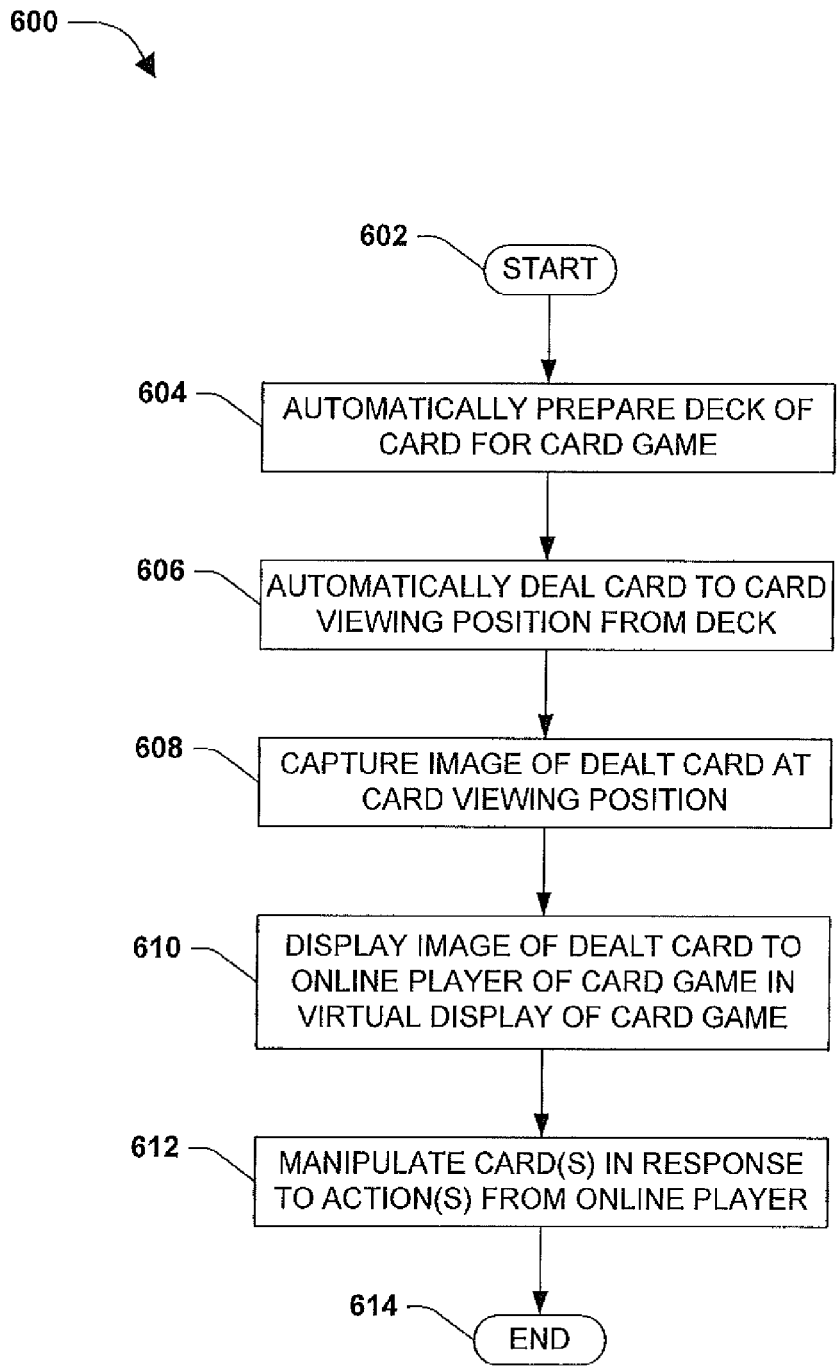
FIG. 6 is a flow diagram of an example method for providing an online card game using real cards.

A method may be devised that utilizes real cards in a display to online players. FIG. 6 is a flow diagram of an example method 600 for providing an online card game using real cards. The example method begins at 602 and involves automatically preparing a deck of playing cards for use in the card game, at 604. For example, cards can be automatically mixed, evaluated and shuffled in preparation for game play. At 606, a playing card is automatically dealt to a card viewing position from the deck of playing cards. For example, a mechanism can be used to automatically deal cards to respective players of an online game.

At 608, an image of the dealt playing card is captured from the card viewing position. For example a camera can capture a still image of the card, and/or a camera may capture a live video feed (e.g., or recorded video feed) of the card. The image of the dealt playing card is displayed to an online player of the card game in a virtual display of one or more portions of the card game, at 610. For example, the image (e.g., a video feed) of the card can be displayed to one or more users, by integrating the image into the virtual card game. In this example, computer-based card games typically comprise virtual representations (e.g., not actual images) of a card game. In this example, instead of using virtualized representations of a player's or community card the actual image of the card is displayed to the one or more users, as appropriate for the card game.

At 612, one or more playing cards are manipulated in response to one or more actions from the online player. For example, an action by a player in the online game can actually cause an automatic response that manipulates the playing card according to the players' intended actions. Having manipulated the card in response to a player's action(s), the example method ends at 614.

Figure 7:
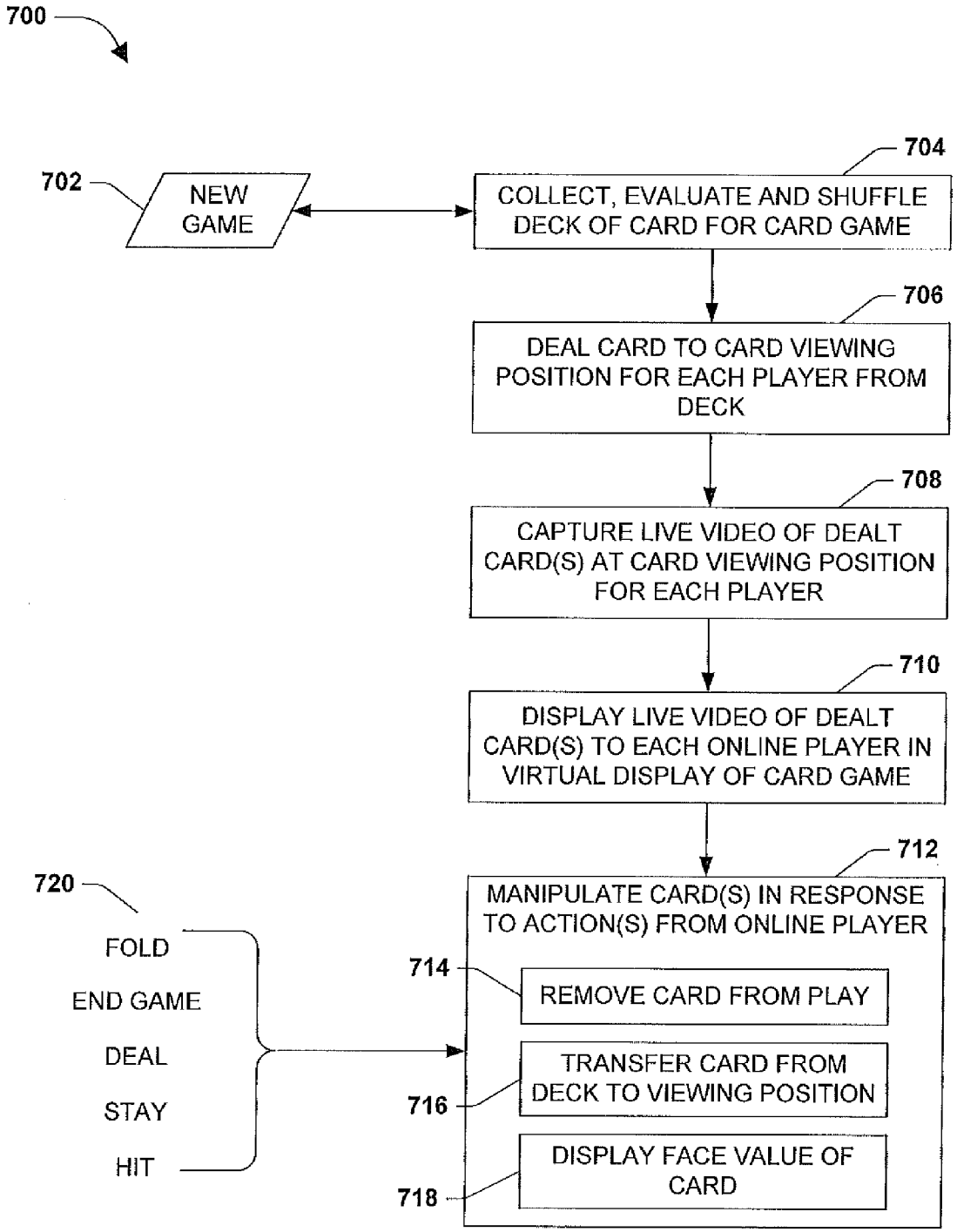
FIG. 7 is a flow diagram illustrating an example embodiment of one or more techniques described herein.

FIG. 7 is a flow diagram illustrating an example embodiment 700 of one or more techniques described herein. At 704, a new card game is indicated 702, such as when a game ends (e.g., a hand ends). The cards can be automatically collected from discard, for example, evaluated to ensure a proper deck (e.g., appropriate number and type of cards present), and shuffled in preparation for the new game. At 706, a card can be automatically dealt to respective card viewing positions, such as held in a card holder, where respective viewing positions correspond to appropriate positions for the desired game. For example, when playing five card draw with four players, five "down" cards can be dealt to each player, comprising twenty card viewing positions (e.g., five for each player).

At 708, a live video feed can be captured for the respective card viewing positions, for each player. For example, one or more cameras may be deployed to capture images of the cards in the viewing positions. In one embodiment, one camera may be used per viewing position. In an alternate embodiment, a sufficient number of cameras may be used that appropriately capture images of the cards for the respective players, for example, while maintaining privacy of each players hand. At 710, the live video of the dealt cards is displayed to each of the online player in a virtual display of the card game, according to appropriate game conventions. For example, in the five card draw game, a virtual version of the game can be displayed to each player, and each player can view a live video image of their down cards that are in the card viewing position.

At 712, the playing card can be manipulated response to one or more actions from one or more online players. In this embodiment, for example, a player's action 720 can comprise folding (e.g., quitting the hand). In this example, at 714, when the player indicates a fold action in the virtual game or the game/hand has ended, this can indicate a removal action, where the one or more player cards are removed from the game, at 714. Further, for example, when a player indicates a deal action, such as when starting a new hand, or a hit action, such as when taking another card in blackjack, the card can be transferred from the deck to the viewing position (e.g., new hand, new card). Further, when a player indicates a stay action, for example, a display action may be indicated that causes a face value of the card to be revealed, at 718. For example, if a player stays, this may cause another player or dealer to show the face of their cards.

Figure 8:
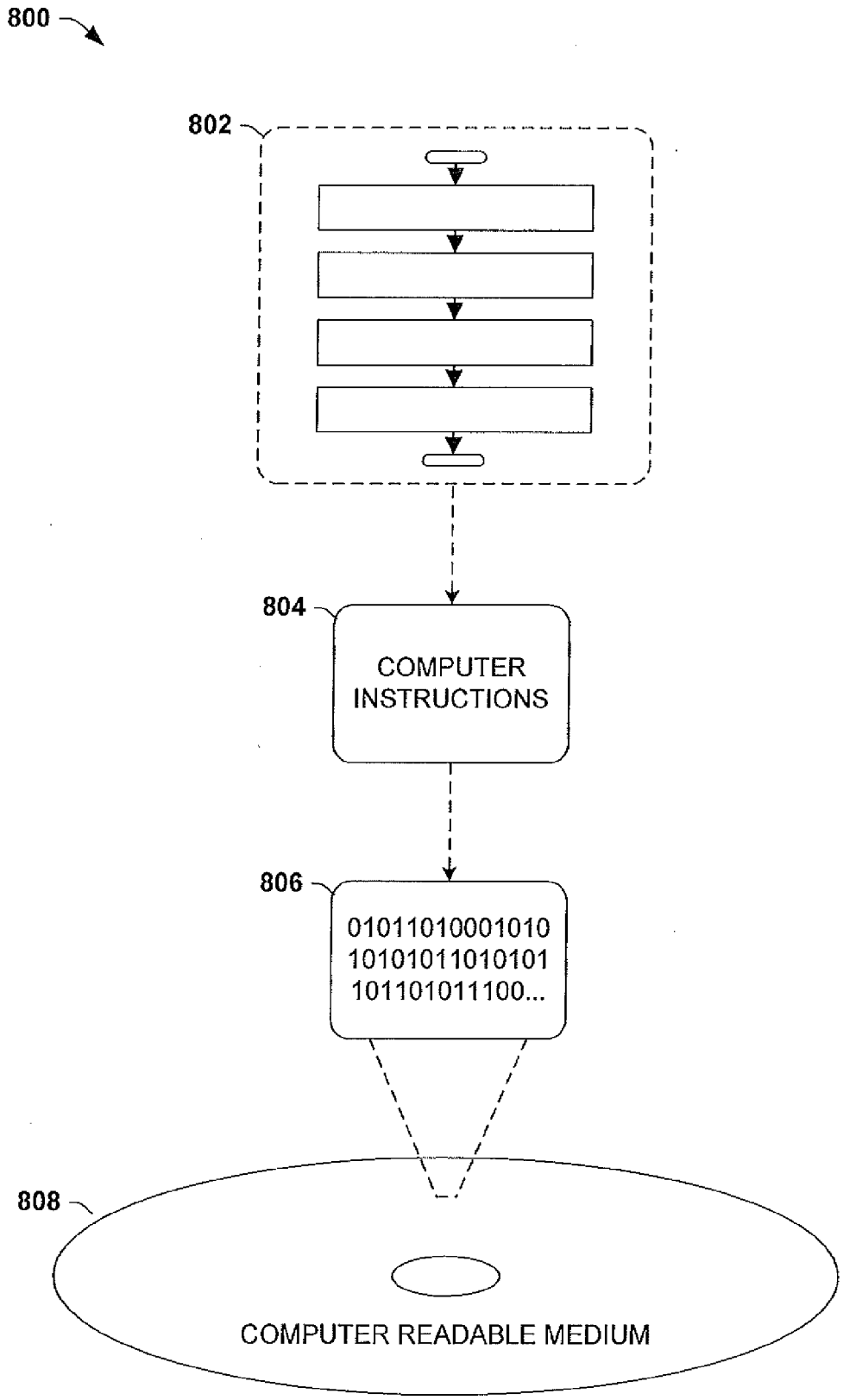
FIG. 8 is an illustration of an exemplary computer-readable medium comprising processor-executable instructions configured to embody one or more of the provisions set forth herein.

Still another embodiment involves a computer-readable medium comprising processor-executable instructions configured to implement one or more of the techniques and/or system presented herein. An exemplary computer-readable medium that may be devised in these ways is illustrated in FIG. 8, wherein the implementation 800 comprises a computer-readable medium 808 (e.g., a CD-R, DVD-R, or a platter of a hard disk drive), on which is encoded computer-readable data 806. This computer-readable data 806 in turn comprises a set of computer instructions 804 configured to operate according to one or more of the principles set forth herein. In one such embodiment 802, the processor-executable instructions 804 may be configured to perform a method, such as the exemplary method 600 of FIG. 6, for example. In another such embodiment, the processor-executable instructions 804 may be configured to implement a system, such as the exemplary system 400 of FIG. 4, for example. Many such computer-readable media may be devised by those of ordinary skill in the art that are configured to operate in accordance with the techniques presented herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

As used in this application, the terms "component," "module," "system", "interface", and the like are can refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, system, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, those skilled in the art will recognize many modifications may be made to this configuration without departing from the scope or spirit of the claimed subject matter.

Figure 9:
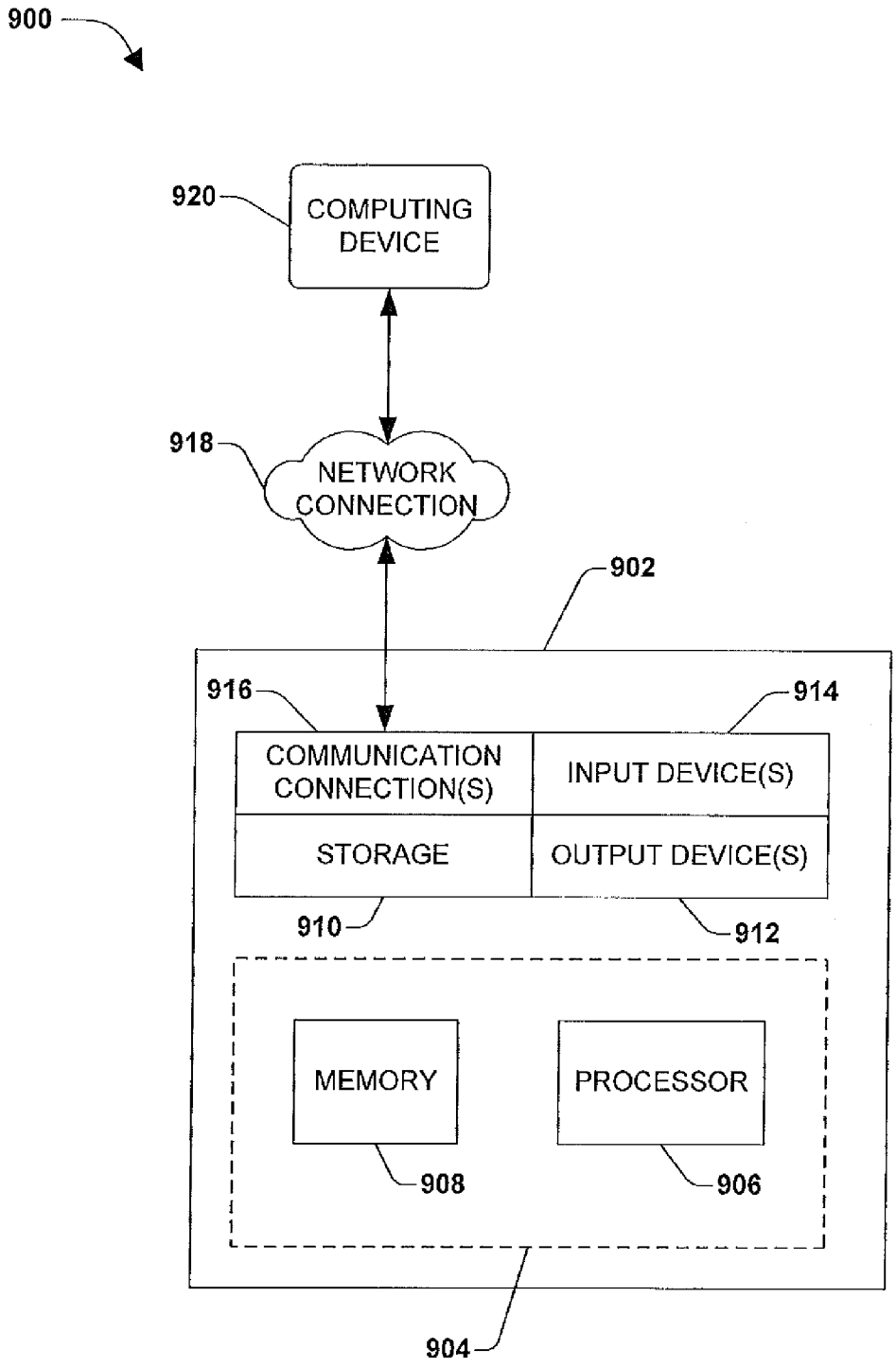
FIG. 9 illustrates an exemplary computing environment wherein one or more of the provisions set forth herein may be implemented.

FIG. 9 and the following discussion provide a brief, general description of a suitable computing environment to implement one or more embodiments of one or more of the provisions, component and the like, set forth herein. The operating environment of FIG. 9 is only one example of a suitable operating environment and is not intended to suggest any limitation as to the scope of use or functionality of the operating environment. Example computing devices include, but are not limited to, personal computers, server computers, hand-held or laptop devices, mobile devices (such as mobile phones, Personal Digital Assistants (PDAs), media players, and the like), multiprocessor systems, consumer electronics, mini computers, mainframe computers, distributed computing environments that include any of the above systems or devices, and the like.

Although not required, embodiments are described in the general context of "computer readable instructions" being executed by one or more computing devices. Computer readable instructions may be distributed via computer readable media (discussed below). Computer readable instructions may be implemented as program modules, such as functions, objects, Application Programming Interfaces (APIs), data structures, and the like, that perform particular tasks or implement particular abstract data types. Typically, the functionality of the computer readable instructions may be combined or distributed as desired in various environments.

FIG. 9 illustrates an example of a system 910 comprising a computing device 912 configured to implement one or more embodiments provided herein. In one configuration, computing device 912 includes at least one processing unit 916 and memory 918. Depending on the exact configuration and type of computing device, memory 918 may be volatile (such as RAM, for example), non-volatile (such as ROM, flash memory, etc., for example) or some combination of the two. This configuration is illustrated in FIG. 9 by dashed line 914.

In other embodiments, device 912 may include additional features and/or functionality. For example, device 912 may also include additional storage (e.g., removable and/or non-removable) including, but not limited to, magnetic storage, optical storage, and the like. Such additional storage is illustrated in FIG. 9 by storage 920. In one embodiment, computer readable instructions to implement one or more embodiments provided herein may be in storage 920. Storage 920 may also store other computer readable instructions to implement an operating system, an application program, and the like. Computer readable instructions may be loaded in memory 918 for execution by processing unit 916, for example.

The term "computer readable media" as used herein includes computer storage media. Computer storage media includes volatile and nonvolatile, removable and non-removable media implemented in any method or technology for storage of information such as computer readable instructions or other data. Memory 918 and storage 920 are examples of computer storage media. Computer storage media includes, but is not limited to, RAM, ROM, EEPROM, flash memory or other memory technology, CD-ROM, Digital Versatile Disks (DVDs) or other optical storage, magnetic cassettes, magnetic tape, magnetic disk storage or other magnetic storage devices, or any other medium which can be used to store the desired information and which can be accessed by device 912. Any such computer storage media may be part of device 912.

Device 912 may also include communication connection (s) 926 that allows device 912 to communicate with other devices. Communication connection(s) 926 may include, but is not limited to, a modem, a Network Interface Card (NIC), an integrated network interface, a radio frequency transmitter/receiver, an infrared port, a USB connection, or other interfaces for connecting computing device 912 to other computing devices. Communication connection(s) 926 may include a wired connection or a wireless connection. Communication connection(s) 926 may transmit and/or receive communication media.

The term "computer readable media" may include communication media. Communication media typically embodies computer readable instructions or other data in a "modulated data signal" such as a carrier wave or other transport mechanism and includes any information delivery media. The term "modulated data signal" may include a signal that has one or more of its characteristics set or changed in such a manner as to encode information in the signal.

Device 912 may include input device(s) 924 such as keyboard, mouse, pen, voice input device, touch input device, infrared cameras, video input devices, and/or any other input device. Output device(s) 922 such as one or more displays, speakers, printers, and/or any other output device may also be included in device 912. Input device(s) 924 and output device (s) 922 may be connected to device 912 via a wired connection, wireless connection, or any combination thereof. In one embodiment, an input device or an output device from another computing device may be used as input device(s) 924 or output device(s) 922 for computing device 912.

Components of computing device 912 may be connected by various interconnects, such as a bus. Such interconnects may include a Peripheral Component Interconnect (PCI), such as PCI Express, a Universal Serial Bus (USB), firewire (IEEE 1394), an optical bus structure, and the like. In another embodiment, components of computing device 912 may be interconnected by a network. For example, memory 918 may be comprised of multiple physical memory units located in different physical locations interconnected by a network.

Those skilled in the art will realize that storage devices utilized to store computer readable instructions may be distributed across a network. For example, a computing device 930 accessible via network 928 may store computer readable instructions to implement one or more embodiments provided herein. Computing device 912 may access computing device 930 and download a part or all of the computer readable instructions for execution. Alternatively, computing device 912 may download pieces of the computer readable instructions, as needed, or some instructions may be executed at computing device 912 and some at computing device 930.

Various operations of embodiments are provided herein. In one embodiment, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each embodiment provided herein.

Moreover, the word "exemplary" is used herein to mean serving as an example, instance, or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims may generally be construed to mean "one or more" unless specified otherwise or clear from context to be directed to a singular form.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising."

What is claimed is:

1. An apparatus for playing an online card game using a deck of real playing cards with each of said playing cards having a face and a back, comprising:

a card delivery component configured to automatically deliver one of said real playing cards;

a card holding component comprising a plurality of card holding positions sufficient for playing said card game with a desired number of players, said card holding component configured to receive said playing card delivered from said card delivery component and hold said playing card in one of said card holding positions so that said playing card face can be viewed from a card view position on a face side of said playing cards;

a card transport structure positioned between said card dealing component and said card holding position, wherein said card transport structure comprises a card delivery chute that extends between said card dealing component and said card holding position;

a card image capture component configured to automatically capture a card image of said playing card face in said card holding position from said card view position;

a game image capture component configured to automatically capture one or more game images of said card delivery component, said playing card backs, and said card holding component during said card game from one or more game viewing positions on a back side of said playing cards, said one or more game images from said one or more game viewing positions comprising one or more of said playing cards handled by said card delivery component and said card holding component;

an image transmittal component configured to automatically transmit said card image and said game image; and a remote game displaying component configured to automatically receive said card image and said game image from said image transmittal component and format said card and game images for display to a respective one of said players.

2. The apparatus of claim 1, further comprising a card retrieval component configured to automatically collect said card when discarded from said card holding position for reorganization into a reorganized deck of said cards.

3. The apparatus of claim 1, further comprising a card evaluation component configured to automatically evaluate said deck of playing cards to determine whether said deck is suitable for use in said game.

4. The apparatus of claim 1, further comprising a card shuffling component configured to automatically shuffle said deck of playing cards prior to using said deck in said card game.

5. The apparatus of claim 1, wherein said card delivery component further comprises a card dealing component configured to automatically remove said playing card from a top of said deck for delivery to said card holding position.

6. The apparatus of claim 1, wherein said card delivery component is further configured to move to sequential ones of said card holding positions of the said card holding component to deliver said playing cards from the said deck.

7. The apparatus of claim 2, wherein said card holding component further comprises a discard component associated with said card holding position and configured to automatically release said playing card from said card holding position to said card retrieval component for reorganization into said reorganized deck of playing cards.

8. The apparatus of claim 1, further comprising a code scanning component configured to read a code disposed on said playing card from said first view position to determine one or more of:

a value of said playing card; and security information for said playing card.

9. The apparatus of claim 1, further comprising a remote connection to said remote game displaying component, said remote game displaying component configured to provide one or more of:

a digital animation of said card game for one or more of said players; and one or more of said card image and said game image.

10. A method for providing an online card game using a deck of real playing cards with each of said playing cards having a face and a back, comprising:

automatically preparing the deck of playing cards for use in the card game;

automatically dealing one of the playing cards from the deck of playing cards by a real card playing component and delivering the dealt playing card to a card holding position by a card transport structure including a card delivery chute that extends between said card dealing component and said card holding position;

automatically capturing a card image of the dealt playing card face in the card holding position from a card viewing position on a face side of the playing cards using a card image capture device;

automatically displaying the card image of the dealt playing card to an online player of the card game in a virtual display of one or more portions of the card game;

automatically capturing a game image of the playing card backs and the real card playing component dealing and holding the playing cards from a game viewing position on a back side of the playing cards;

automatically displaying the game image of the real card playing component to the online player; and automatically manipulating the playing card in response to one or more actions from the online player, one or more portions of the method performed, at least in part, by a processing unit.

11. The method of claim 10, wherein automatically capturing a card image of the dealt playing card comprises capturing live video of the dealt playing card; and wherein automatically displaying the card image of the dealt playing card to the online player comprises displaying the live video of the dealt card to the online player.

12. The method of claim 10, further comprising manipulating the playing card in response to one or more actions from the online players, the manipulating step comprising one of more of:

removing an out-of-play one of the playing cards to an automatic card collector when the online player indicates a removal action for the out-of-play playing card;

transferring a top one of the cards from the deck of playing cards to the card holding position when the online player indicates a deal action for the top card; and displaying a face value of a revealed one of the playing cards when the online player indicates a display action for the revealed playing card.

13. The apparatus of claim 1, wherein said card holding component further comprises a plurality of viewing windows with each defined at a respective one of said card holding positions to allow said card in said card holding position to be viewed from said card viewing position.

14. The apparatus of claim 13, wherein said card holding component further comprises a plurality of slots with each defined at a respective one of said card holding positions to allow said card to be housed in said card holding position.

15. The apparatus of claim 14, wherein said card holding component further comprises a rack defining said plurality of slots in a series arrangement and said plurality of viewing windows in a series arrangement.

16. The apparatus of claim 5, further comprising a card transport structure positioned between said card dealing component and said card holding position.

17. An apparatus for playing an online card game using a deck of real playing cards, comprising:

a card delivery component configured to automatically remove one of said real playing cards from a top of said deck and to automatically deliver said playing card;

a card holding component comprising a plurality of card holding positions sufficient for playing said card game with a desired number of players, said card holding component configured to receive said playing card delivered from said card delivery component and hold said playing card in one of said card holding positions so that it can be viewed from a card view position;

a card transport structure positioned between said card dealing component and said card holding position, wherein said card transport structure comprises a card delivery chute that extends between said card dealing component and said card holding position;

a card image capture component configured to automatically capture a card image of said playing card in said card holding position from said card view position;

a game image capture component configured to automatically capture one or more game images of said card delivery component and said card holding component during said card game from one or more game viewing positions, said one or more game images from said one or more game viewing positions comprising one or more of said playing cards handled by said card delivery component and said card holding component;

an image transmittal component configured to automatically transmit said card image and said game image; and a remote game displaying component configured to automatically receive said card image and said game image from said image transmittal component and format said card and game images for display to a respective one of said players.

18. An apparatus for playing an online card game using a deck of real playing cards, comprising:

a card delivery component configured to automatically deliver one of said real playing cards;

a card holding component comprising a plurality of card holding positions sufficient for playing said card game with a desired number of players, wherein said card holding component is configured to receive said playing card delivered from said card delivery component and hold said playing card in one of said card holding positions so that it can be viewed from a card view position, wherein said card holding component further comprises a discard component associated with said card holding position and configured to automatically release said playing card from said card holding position, and wherein said discard component includes an outlet door that moves from a closed position retaining said card in said card holding position to an open position permitting said card to exit said card holding position;

a card retrieval component configured to automatically collect said card when discarded from said card holding position for reorganization into a reorganized deck of said cards;

a card image capture component configured to automatically capture a card image of said playing card in said card holding position from said card view position;

a game image capture component configured to automatically capture one or more game images of said card delivery component and said card holding component during said card game from one or more game viewing positions, said one or more game images from said one or more game viewing positions comprising one or more of said playing cards handled by said card delivery component and said card holding component;

an image transmittal component configured to automatically transmit said card image and said game image; and a remote game displaying component configured to automatically receive said card image and said game image from said image transmittal component and format said card and game images for display to a respective one of said players.

19. The apparatus of claim 1, wherein said card delivery component, said card image capture, said game image capture component, said image transmittal component, and said remote game displaying component are all automated such that a human dealer is not required for said game to be played.

20. The apparatus of claim 17, wherein said card delivery chute is configured to reorient said card from a horizontal position in said card dealing component to a vertical position in said card holding position.

* * * * *